United States Patent [19]

Madigan

[11] 4,315,598

[45] Feb. 16, 1982

[54] HEAT EMITTER UNIT FOR A HOT WATER HEATING SYSTEM

[75] Inventor: Stephen M. Madigan, Nutley, N.J.

[73] Assignee: Danfoss A/S, Nordborg, Denmark

[21] Appl. No.: 173,985

[22] Filed: Jul. 31, 1980

[51] Int. Cl.[3] ..... F24H 3/00

[52] U.S. Cl. ..... 237/70; 165/39

[58] Field of Search ..... 237/70; 165/39

[56] References Cited

U.S. PATENT DOCUMENTS

| | | | |
|---|---|---|---|
| 245,380 | 8/1881 | Horton | 165/59 |
| 619,264 | 2/1899 | Baltaasar | 237/70 |
| 1,161,872 | 11/1915 | McElroy | 165/95 |
| 1,932,069 | 10/1933 | Ercanbrack et al. | 237/56 |
| 4,178,907 | 12/1979 | Sweat, Jr. | 237/19 |

*Primary Examiner*—Ronald C. Capossela

*Attorney, Agent, or Firm*—Wayne B. Easton

[57] ABSTRACT

The invention relates to a heat emitter unit for a hot water heating system. The heat emitter unit is characterized by a valve and a heat emitter unit being integrated in a manner so that the valve casing and the heat emitter pipe to which fins are attached are in axial alignment. The heat emitter pipe has a central tube arrangement which provides in parallel a central bypass and a surrounding valve controlled passage. Heat from hot water flowing through the surrounding valve controlled passage is transferred through the finned pipe to the fins.

3 Claims, 1 Drawing Figure

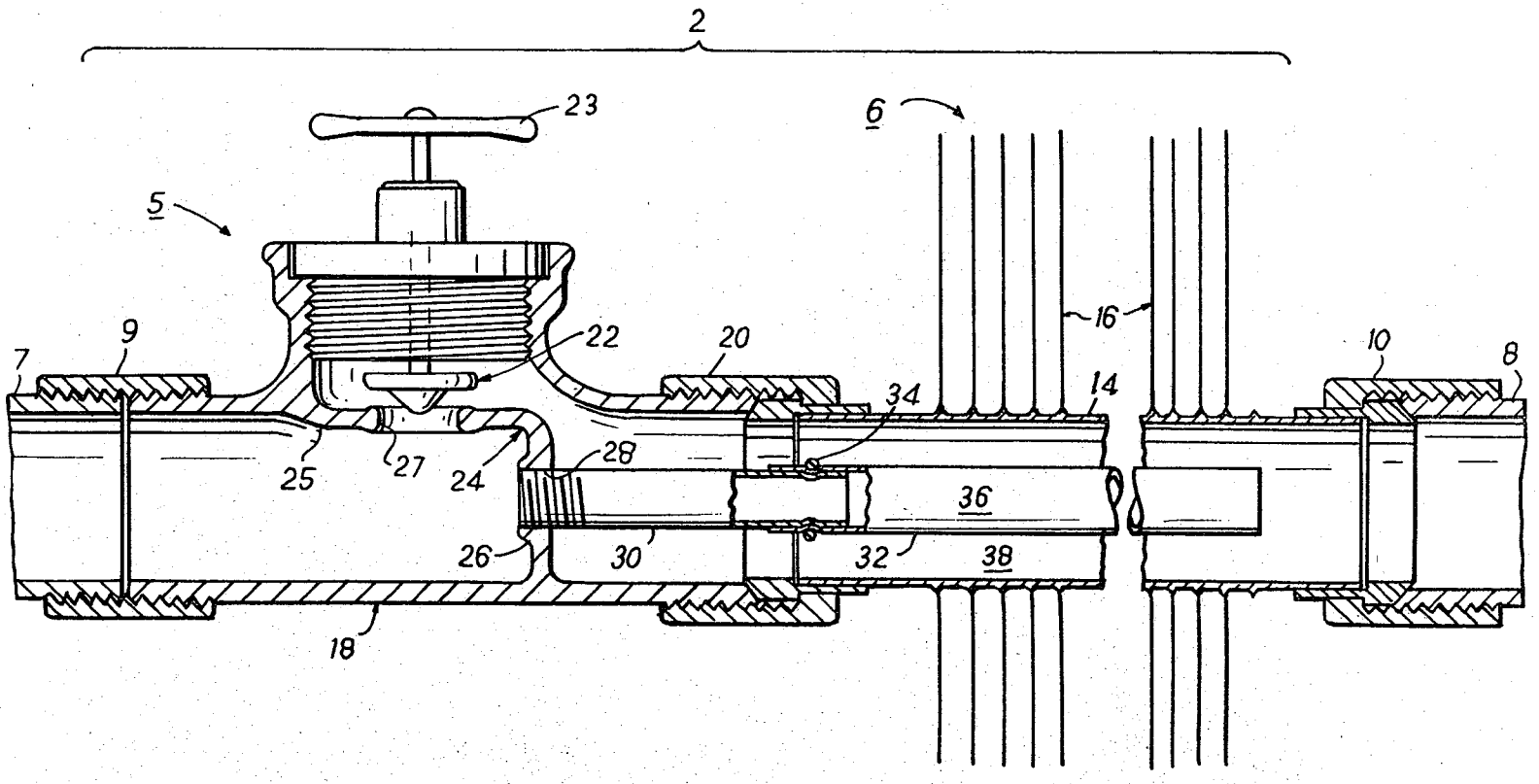
2
5
6
7
8
9
10
14
16
18
20
22
23
24
25
26
27
28
30
32
34
36
38

HEAT EMITTER UNIT FOR A HOT WATER HEATING SYSTEM

The invention relates to a heat emitter unit for a hot water heating system.

A patent search revealed U.S. Pat. Nos. 245,380; 1,161,872; 1,932,069 and 4,178,907 but none of these patents are of sufficient relevance to warrant a discussion thereof.

In prior art one-pipe type hot water heating systems a pipe loop arrangement extends from a heat generator such as a boiler through the rooms to be heated and back to the intake of the generator. A form of pump such as a centrifugal pump is utilized to circulate hot water from the heat generator through the loop. In each room one or more heat emitter units such as a radiator or baseboard type heat convector is attached in parallel to a section of the loop. A valve is provided for diverting a portion of the hot water flowing through the loop through the heat emitter unit.

The above apparatus provides an efficient heat transfer system but such apparatus is physically awkward and relatively expensive.

A main object of the invention is to provide a new and improved heat emitter unit in which the valve and heat emitter unit are integrated in a manner so that the valve casing and the heat emitter pipe to which the fins are attached are in axial alignment with the heat emitter pipe having a central tube arrangement which provides in parallel a central bypass and a surrounding valve controlled passage from which heat from hot water flowing therethrough is transferred to the fins. A further object is to provide apparatus of this type which is easier to accommodate architectually and is more economical cost than comparable prior art apparatus.

Other objects and advantages will become apparent from the following specification, the appended claims and the attached drawing.

The drawing is a cross-sectional view of a heat emitter unit for a hot water heating system which embodies the invention.

A heat emitter unit 2 shown in the drawing comprises a valve section 5 and a heat emitter section 6. Heat emitter section 6 is illustrated as being broken longitudinally to indicate that it may be of any desired suitable length.

The heat emitter unit 2 is an element in a series pipe circuit which forms a loop supplied by a heat generator such as a boiler and runs from room to room. As an element in this circuit the heat emitter unit 2 is connected to pipes 7 and 8 on opposite sides thereof with unions 9 and 10.

Heat emitter section 6 is of the extended surface type having a tube or convector pipe 14 made of copper, aluminum or steel with a plurality of spaced apart fins 16 made of thin metal plates attached thereto.

Heat emitter units such as the unit 2 are normally mounted on outer walls of rooms just above the floor and usually under windows. A cabinet type convector (not shown) which would surround the heat emitter section 6 is normally provided to effect thermal convection for heat transfer to the air in the room. The convector cabinet is usually of steel and would have front and rear walls closely adjacent the front and rear sides of the heat emitter section 6 to prevent bypassing thereof and to insure air movement through the heat emitter section from bottom to top by the stack or flue effect. Openings would be provided in the cabinet below and above the heat emitter section 6 for the entrance and egress of air.

Valve section 5 has a casing 18 and is illustrated as being attached to convector pipe 14 of the heat emitter section 6 with a union 20. Valve section 5 has an internal closure member 22 which is illustrated as being manually operable with a handle 23 but an arrangement could be provided whereby it could also be operated by control means under the control of a room thermostat.

Valve section 5 has a partition 24 with horizontal and vertical sections 25 and 26. Horizontal section 25 has an opening which is cooperable with and forms a valve seat 27 for closure member 22. Vertical section 26 has a central opening 28 to which is attached a tube 30 which extends to the end of the valve casing 18 and is preferrably rigid in character. Tube section 30 may be of any suitable material.

An alternative but more expensive valve construction would involve a 3-way valve with a closure member which could be operated to alternately close openings 27 and 28, An insulating tube 32 is connected to tube 30 with a spring clip 34 and extends axially so as to be generally coextensive with the heat emitter section 6. With this construction there is on the downstream side of the partition 24 a central passage 36 formed by the tubes 30 and 32 and an annular passage 38 formed between the tubes on the one hand and the surrounding valve casing 18 and heat emitter pipe section 14 on the other.

In operation, with valve 5 closed, the flow of hot water is continuous from the upstream side on the left through passage 36 with the egress being downstream from the fins 16. Static pressure in the system will cause the annular passage 38 to fill with water but the water therein will be relatively stagnant because it is trapped by reason of valve 5 being closed. Insulating tube 32 has a relatively low coefficient of heat transfer and thus only a very small amount of heat is transmitted from the hot water flowing in tube 32 to the water in the surrounding annular chamber 38.

When valve 5 is opened the flow of hot water has parallel paths through the central passage 36 and through the valve opening 27 to annular passage 38. The hot water flowing through annular passage 38 is in good heat transmitting relation to the fins 16 through the pipe 14 and heat is consequently imparted to room air which flows upwardly between the fins 16.

The pressure drops across the passages 36 and 38 are, of course, similar and the relative rates of flow through the passages are thus determined by the respective resistances to flow presented by the passages. This is a system design consideration dependent on desired performance characteristics and the respective resistances of the passages 36 and 38 are entirely optional within the scope of the invention. Also valve 5 may also be operated in a modulating mode so that different throttle resistances are set by varying the size of the opening between closure member 22 and the seat 27 thereof.

When a room condition is satisfied and the valve is closed, all of the circulating water flows through the central bypass tube. The stream in the bypass tube, having little or no contact with the convector pipe 14 in the vicinity of the fins loses little heat to the pipe 14. In this respect tests have shown that the heat emitter output of the finned unit 6 has a range of from 100 per cent when valve 22 is fully opened down to only about 20 per cent when valve 22 is fully closed.

Although the main concept of the invention involves having the tube 32 extending to a point in the vicinity of the downstream side of the fins 16, an additional advantage is obtained by extending the tube a somewhat further distance past that point. Such advantages is the avoidance of eddies of hot water in the vicinity of the downstream side of the fins.

I claim:

1. A heat emitter unit for a hot water heating system, comprising, a valve section having a casing, a heat emitter section including a pipe section and fin means attached to said pipe section, means connecting said valve and pipe sections, partition means for said valve casing having a bypass opening and a valve seat opening, centrally disposed tube means forming a central passage and an annular passage, said tube means extending from said bypass opening to a point generally aligned with the downstream side of said fin means, and controllable closure means for cooperation with said valve seat opening to control the flow of fluid through said passage.

2. A heat emitter unit according to claim 1 wherein at least a portion of said tube means in the vicinity of said fins means is of a heat insulating material.

3. A heat emitter unit according to claim 1 wherein said partition means has horizontal and vertical sections in which said valve seat and bypass openings are respectively disposed.

* * * * *